US010923086B2

(12) United States Patent
Hackett

(10) Patent No.: US 10,923,086 B2
(45) Date of Patent: Feb. 16, 2021

(54) COMPACT STRING TENSION REGULATION APPARATUS FOR TREMOLO SYSTEMS

(71) Applicant: Mark E. Hackett, Lago Vista, TX (US)

(72) Inventor: Mark E. Hackett, Lago Vista, TX (US)

( * ) Notice: Subject to any disclaimer, the term of this patent is extended or adjusted under 35 U.S.C. 154(b) by 0 days.

(21) Appl. No.: 16/252,586

(22) Filed: Jan. 19, 2019

(65) Prior Publication Data

US 2019/0228746 A1 Jul. 25, 2019

Related U.S. Application Data

(60) Provisional application No. 62/619,658, filed on Jan. 19, 2018.

(51) Int. Cl.

| | |
|---|---|
| ***G10D 3/14*** | (2020.01) |
| ***G10D 3/153*** | (2020.01) |
| ***G10D 1/08*** | (2006.01) |

(52) U.S. Cl.

CPC ..... *G10D 3/153* (2020.02); *G10D 1/085* (2013.01)

(58) Field of Classification Search

CPC ..... G10D 3/146; G10D 1/085

See application file for complete search history.

(56) References Cited

U.S. PATENT DOCUMENTS

| | | | | |
|---|---|---|---|---|
| 2,304,597 | A | 12/1942 | Proelsdorfer | |
| 2,741,146 | A | 4/1956 | Fender | |
| 4,171,661 | A | 10/1979 | Rose | |
| 4,497,236 | A | 2/1985 | Rose | |
| 5,359,144 | A * | 10/1994 | Benson | G10O 3/143 84/313 |
| 9,542,915 | B2 | 1/2017 | Hackett | |
| 9,734,804 | B1 | 8/2017 | McCabe | |

* cited by examiner

*Primary Examiner* — Kimberly R Lockett

(74) *Attorney, Agent, or Firm* — Fraley Patent Law, PLLC

(57) ABSTRACT

Compact string tension regulation apparatus for tremolo systems comprising a rotatable body having a protrusion extending from the body. A bearing surface of the protrusion may be selectively engaged with a tremolo to provide a plurality of string tensions.

17 Claims, 7 Drawing Sheets

COMPACT STRING TENSION REGULATION APPARATUS FOR TREMOLO SYSTEMS

CROSS-REFERENCE TO RELATED APPLICATIONS

This application claims a benefit of priority under 35 U.S.C § 119 to Provisional Application No. 62/619,658 filed on Jan. 19, 2018, which is fully incorporated herein by reference in its entirety.

FIELD OF THE INVENTION

This invention is in the general field of musical instruments, specifically directed to guitars, and more particularly is directed to an apparatus for adjusting string tension in a guitar tremolo. It is known by those skilled in the art that the term tremolo is a misnomer for vibrato due to Leo Fender reversing the terms.

BACKGROUND

Fulcrum tremolo systems for musical instruments, and in particular for electric guitars, essentially began with Fender U.S. Pat. No. 2,741,146 ("Fender '146"). Fender '146 utilized a row of six wood screws to fasten the device to the instrument's face while allowing it to pivot to vary the tension of all the strings at once while springs connected underneath maintained a counterbalanced condition. While this did function as intended, in practice movement of the strings produced substantial friction often preventing the strings from returning to the previously tuned condition. Several decades later this issue of string friction inspired a major improvement to fulcrum tremolos as disclosed by Rose U.S. Pat. No. 4,171,166 ("Rose '166"). Rose '166 eliminated friction by clamping or "locking" the strings at both the nut and bridge saddles on tremolo. Other improvements to reduce friction include utilizing a pair of posts rather than the 6 screws to pivot against. Clamping the strings at the nut, however, could cause the strings to slightly de-tune, and as disclosed in Rose U.S. Pat. No. 4,497,236 ("Rose '236"), a fine-tuning capability was incorporated onto the tremolo unit itself to compensate for de-tuning. This was done by creating a two-piece saddle assembly with a pivoting rear element controlled by a continuously variable fine tuner to increase or decrease string tension. This continuously variable type of fine tuning was also disclosed by Proelsdorfer in U.S. Pat. No. 2,304,597.

The device disclosed in Rose '166 introduced new issues, however. One issue was requiring an Allen wrench or hex key to "lock" and "unlock" (i.e., tighten and loosen, secure and remove) the system in order to gain access to tune or replace the strings. Hackett U.S. Pat. No. 9,542,915 ("Hackett '915") addressed this issue with an improved "Keyless Locking Tremolo System" which allows access to the strings and tuning without requiring external tools.

Further improvement to fulcrum tremolos is disclosed by Benson U.S. Pat. No. 5,359,144 ("Benson '144"). Commercially known as the D-Tuna®, this "drop tuner" incorporates an integrated fine tuner to calibrate and maintain the desired pitch. To calibrate this integral fine tuner an external tool is needed. This requires first locating and obtaining the proper size hex wrench or Allen key to turn a miniature set screw threaded into the device. This can be especially difficult and inconvenient to accomplish while performing on a dimly lit stage. Due to the miniature size of this integral fine tuner the range of adjustment is very limited. For example, it has been demonstrated to not have enough range to work with lower tension strings such as the Ernie Ball Cobalt Strings.

Sympathetic vibrations from the strings may cause the miniature set screw to vibrate out of adjustment or even become loosened completely allowing it to fall out and be lost. The tiny hex wrench itself may easily be lost or worn from use. Without this external tool it is impossible to calibrate to the desired pitch. Additionally, the set screw can drag and damage the surface of the string lock screw that the device slides along preventing smooth and reliable operation. Depressing the tremolo arm to lower the strings pitch may also cause the device to unintentionally disengage from the intended position.

Benson '144 operates in a linear motion by sliding fore and aft along the smooth shoulder portion of a partially threaded spring-loaded fastener. The device is designed with an elongated physical shape which when installed extends beyond the perimeter of a standard tremolo cavity recessed into the top of many musical instruments. When installed, the extended length prevents tremolos recessed into the cavity from being pulled upward to raise the pitch, defeating the intended functionality of the tremolo. Additionally, Benson '144 is incompatible with the keyless locking tremolo systems disclosed in Hackett '915.

McCabe U.S. Pat. No. 9,734,804 discloses a "drop tuner", however, the device cannot be retrofitted onto locking tremolo systems such as those disclosed in Rose '236 or Hackett '915. Additionally, McCabe '804 requires an external tool to turn an integral set screw to finely tune to pitch. Such a device may be cumbersome to use and tuning can be impossible if the tool is lost.

Therefore, a need exists for a compact and reliable apparatus which avoids these issues.

SUMMARY OF THE INVENTION

A tremolo string tension regulator according to embodiments may comprise a rotatable body having a bearing surface and an axial hole through the rotatable body. The rotatable body may be rotated from a first position to a second position to change the tension in the associated string thus altering pitch. In the first position, the bearing surface engages the tremolo and thus the string is at a first tension. In the second position, the bearing surface does not engage the tremolo, thus causing the string to be at a second tension.

The axial hole may comprise a threaded portion to engage threads of a lock screw to limit axial movement of the regulator. A stop extending axially from the rotatable body may be used to limit rotation of the body. The stop may be offset from a leading edge of the bearing surface to accommodate a fine-tuning screw. In one embodiment, the rotatable body may not have threads in the axial hole and may further comprise a rabbet which, together with a spring, limits axial movement of the rotatable body.

The tremolo string tension regulator eliminates integrated fine tuners or set screws that require external tools to calibrate the pitch. As such there are no tiny set screws that may vibrate out of adjustment or fall out at an inopportune moment.

Rather than sliding axially, the regulator instead revolves around an axis which allows for an extremely compact design that easily fits within a standard recessed tremolo cavity of a guitar without modification of the guitar body. This retains the design function of allowing a tremolo to be raised to alter the pitch of the strings.

The tremolo string tension regulator may retrofit vintage locking tremolos that clamp the plain end of a string by inserting the string from above into the saddles and using a hex key to tighten a threaded fastener clamping the string in the saddle. Additionally, tremolo string tension regulators as described herein may also retrofit keyless locking tremolo systems where the ball end is retained and the plain string end is inserted through the rear of the lock through a hollow passage and exiting from within the saddle and locked by hand with a closure. Tremolo string tension regulator systems may be provided having a keyed or keyless lock screws together with a tremolo string tension regulator. Still more systems may be provided having any combination of parts of a guitar or tremolo as well as any parts described herein.

DETAILED DESCRIPTION

Existing string tension devices suffer from several problems. They may be cumbersome to use, require modification to the guitar body, include small parts which are easily lost, or require tools for adjustment. Modification of the guitar body may result in diminished value of the guitar and be unsightly. The use of tools or small parts may be inconvenient at best in a casual setting but may be disastrous during a live performance.

A tremolo string tension regulator according to embodiments may comprise a rotatable body having a bearing surface and an axial hole through the rotatable body. The rotatable body may be rotated from a first position to a second position to change the tension in the associated string thus altering pitch. In the first position, the bearing surface engages the tremolo and thus the string is at a first tension. In the second position, the bearing surface does not engage the tremolo, thus causing the string to be at a second tension.

The axial hole may comprise a threaded portion to engage threads of a lock screw to limit axial movement of the regulator. A stop extending axially from the rotatable body may be used to limit rotation of the body. The stop may be offset from a leading edge of the bearing surface. In one embodiment, the rotatable body may not have threads in the axial hole and may further comprise a rabbet which, together with a spring, limits axial movement of the rotatable body.

Figure 1:
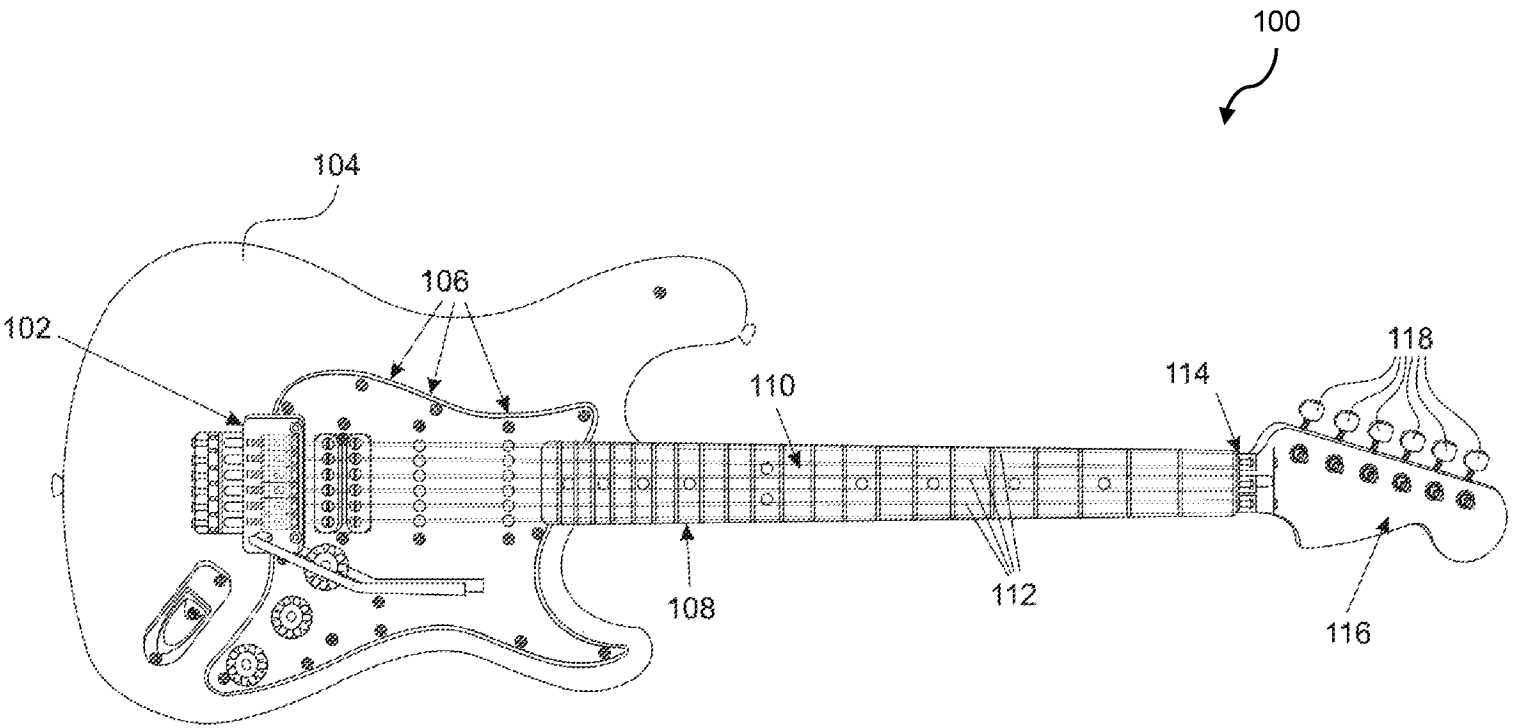
FIG. 1 depicts the typical electric guitar and the various components associated with it.

FIG. 1 illustrates an electric guitar 100 and the various components associated therewith. The components include the tremolo 102, body 104, pickups 106, neck 108, fret board 110, strings 112, nut 114, headstock 116, and tuning machines 118. The tremolo 102 is mounted onto the face of the body 104. A plurality strings 112 are anchored on one end at tremolo 102. The strings extend across the pickups 106, fret board 110, and nut 114 and are anchored on headstock 116 by a plurality of tuning machines 118.

Figure 2:
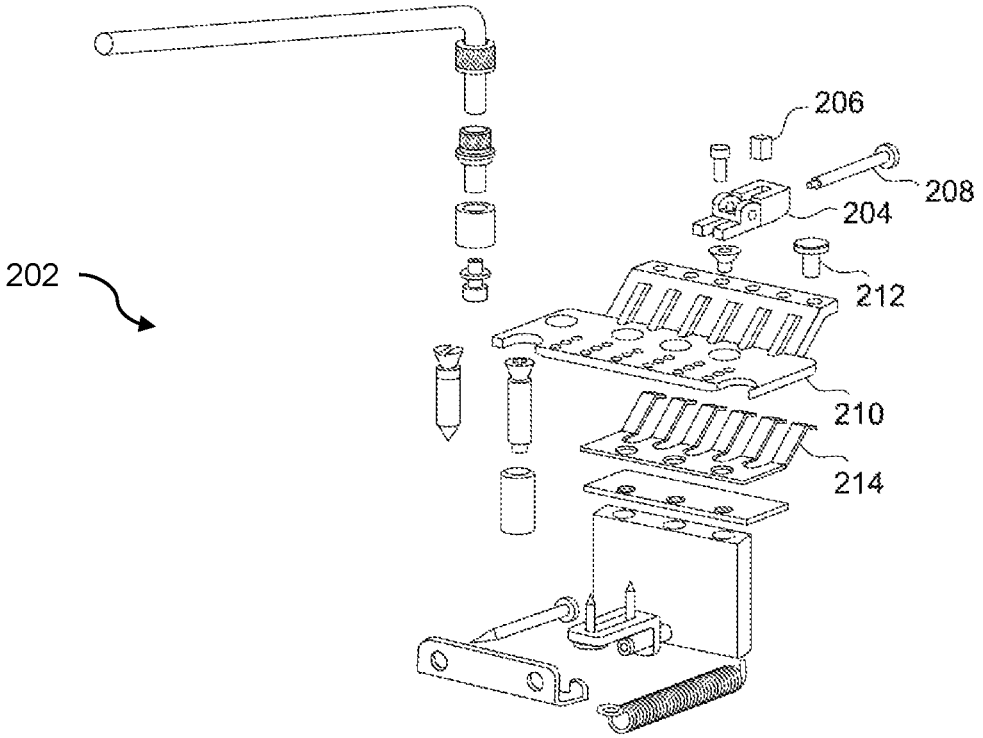
FIG. 2 is an exploded diagram of a locking tremolo system with fine tuners.

FIG. 2 illustrates an exploded view of a tremolo 202. Strings are anchored at tremolo 202 by first placing the plain end of a string within the saddle assembly 204 between saddle assembly 204 and the string lock insert block 206. String lock screw 208 is routed through the back opening in tremolo base plate 210 and threaded into the rear of saddle assembly 204, which is mounted onto tremolo base plate 210. String lock screw 208 contacts string lock insert block 206 and securely fastens the string end between the string lock insert block 206 and the inner wall of saddle assembly 204.

Saddle assembly 204 is fastened to tremolo base plate 210 and employs a hinged knuckle to allow the rear section to pivot when fine tuning screw 212 is rotated in a first direction against string lock screw 208 to increase tension on the string thereby increasing the pitch. Rotating fine tuning screw 208 in a second direction decreases tension on the string and therefore lowers the string pitch. Fine tuner tension plate 214 acts as a row of springs, each of which push a string lock screw against its respective fine-tuning screw.

Figure 3:
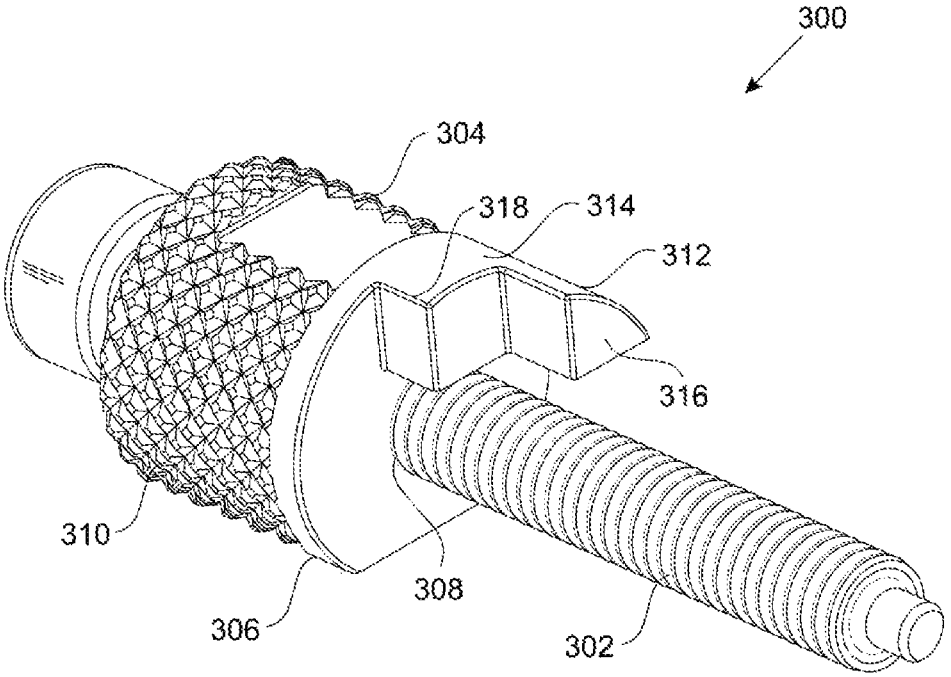
FIG. 3 depicts a tremolo string tension regulator assembly according to one embodiment.

FIG. 3 illustrates one embodiment of a tremolo string tension regulator assembly 300. Tremolo string tension regulator assembly 300 is comprised of a lock screw 302 and a tremolo string tension regulator 304. Tremolo string tension regulator 304 is comprised of a rotatable body 306 having an axial hole 308 through the body capable of receiving lock screw 302. In the embodiment shown in FIG. 3, rotatable body 306 is cylindrical. One skilled in the art would recognize that other suitable geometries, including polygonal (hexagonal, octagonal, etc.), oval, oblong, or non-symmetric geometries may be used without departing from the scope of the invention. Rotatable body 306 may be made of a number of materials including metals such as aluminum, magnesium, steel, brass, or stainless steel, natural materials such as wood or stone, or polymers such as glass-filled nylon, polycarbonate, Delrin, or any other suitable material. Axial hole 308 may be threaded or otherwise engage lock screw 302 to limit axial movement of tremolo string tension regulator 304 along lock screw 302. Rotatable body 306 may include a projection or textured surface to facilitate rotation of rotatable body 306. In the embodiment shown in FIG. 3, textured surface 310 is shown. A textured surface may include knurled, ribbed, or media blasted surfaces. Extending from rotatable body 306 is projection 312. Projection 312 extends axially from rotatable body 306 and includes a bearing surface 314 and a stop 316. Bearing surface 314 extends only partially around the circumference. Leading edge 318 defines one extent of the bearing surface. Stop 316 extends further axially from rotatable body 306 and bearing surface 314. Stop 316 only partially extends around the circumference and is rotationally offset from leading edge 318.

Figure 4:
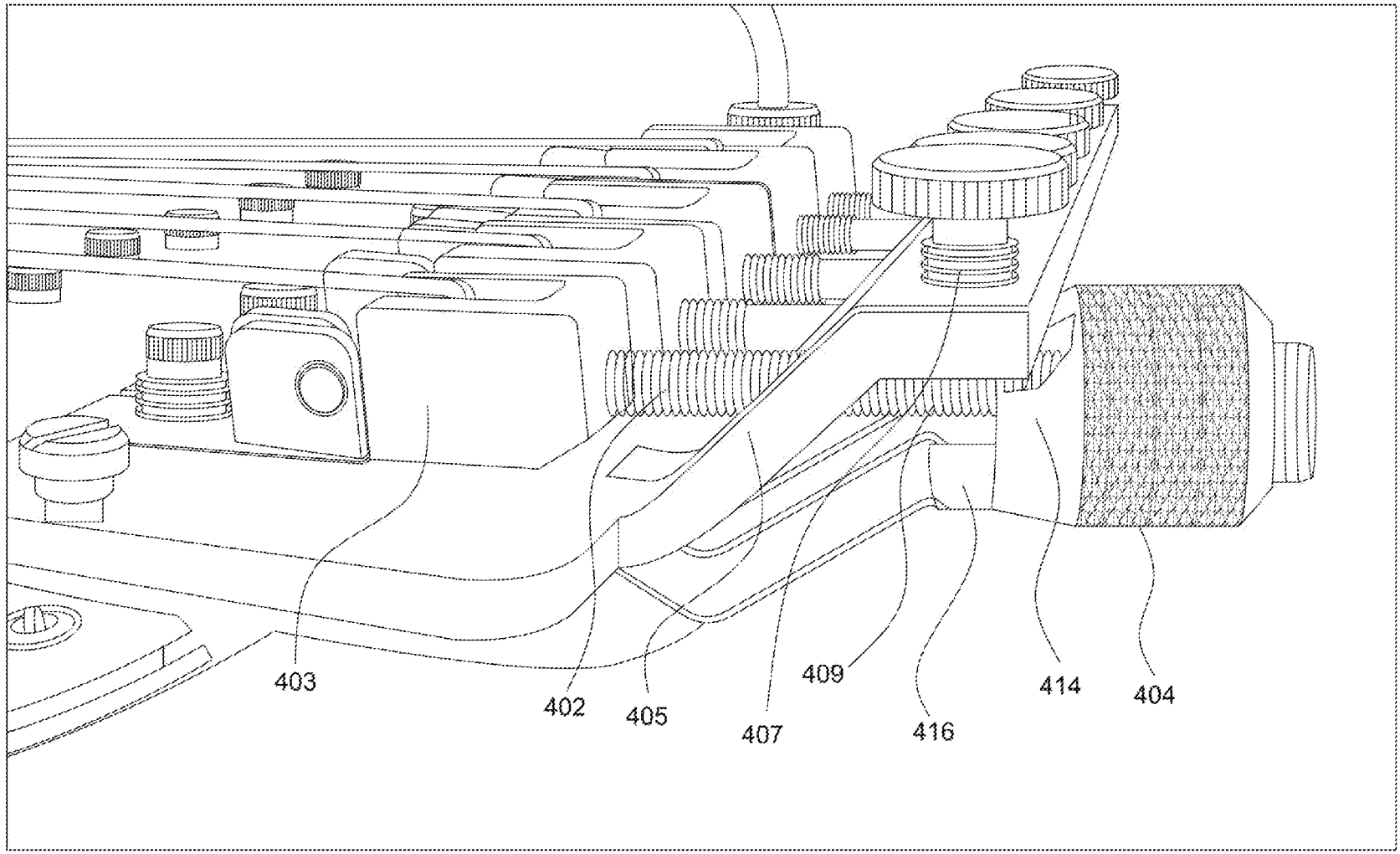
FIG. 4 depicts a tremolo with an installed tremolo string tension regulator assembly in a first position.

FIG. 4 illustrates a tremolo string tension regulator assembly according to the embodiment shown in FIG. 3 installed in a tremolo. Lock screw 402 is threaded into saddle assembly 403. Tremolo string tension regulator 404 is positioned along lock screw 402. Saddle assembly 403 is secured to tremolo base plate 405. Tremolo base plate 405 includes a threaded hole for fine tuner screw 407 to pass through. When fine tuner screw 407 is extend beyond the threaded hole in tremolo base plate 405, fine tuner screw 407 acts as a positive stop for lock screw 402. Fine tuner tension plate 409 applies force to lock screw 402 to keep lock screw 402 held against fine tuner screw 407. Tremolo string tension regulator 404 is in a rotational position where bearing surface 414 does not engage with tremolo base plate 405.

Stop 416 is not engaged with fine tuner screw 407 and may prevent rotation of tremolo string tension regulator 404 due to interference with fine tuner tension plate 409. Thus, in the rotational position shown in FIG. 4, lock screw 402 and saddle assembly 403 cause the string to be held at a first tension.

Figure 5:
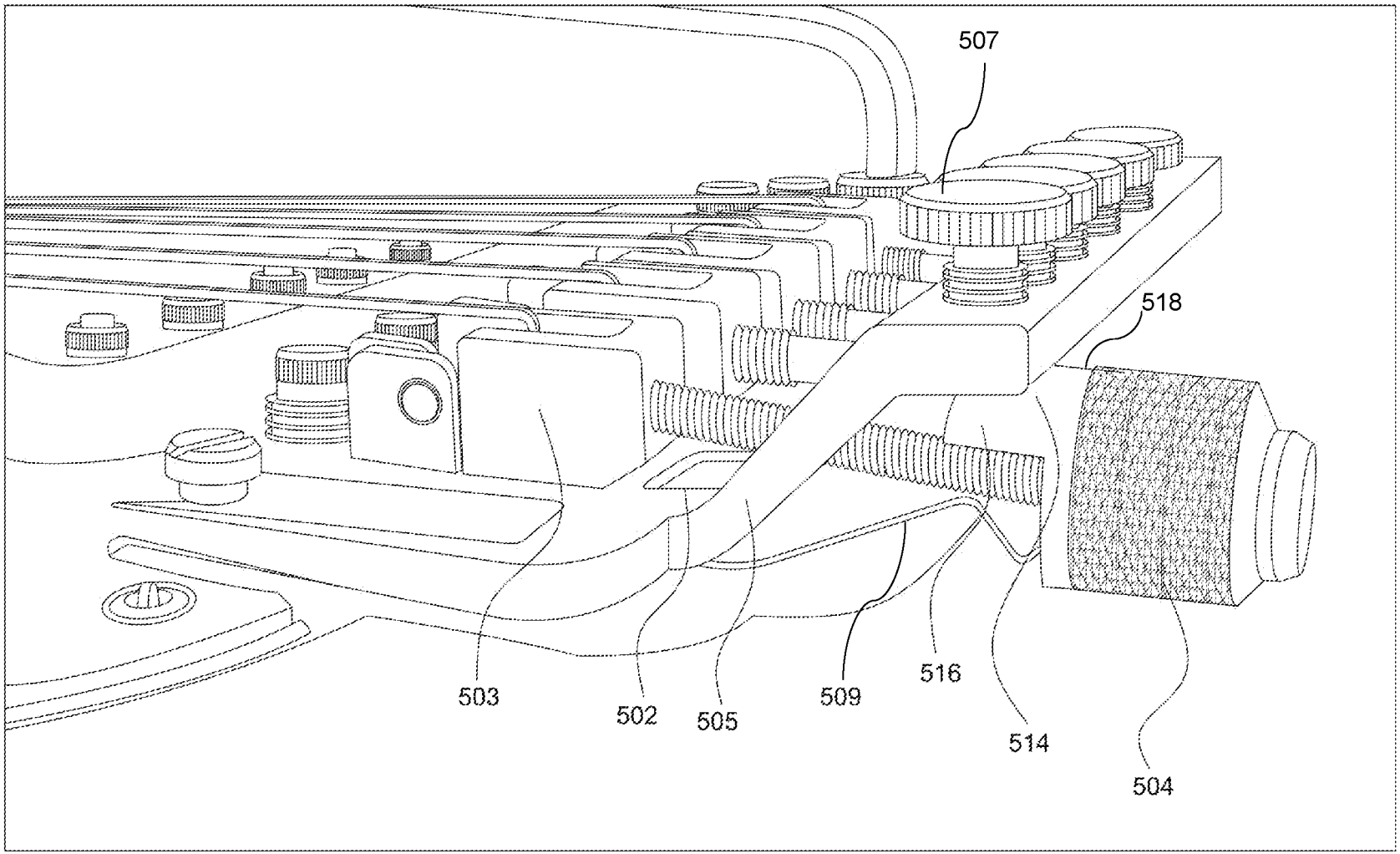
FIG. 5 depicts a tremolo with an installed tremolo string tension regulator assembly in a second position.

In contrast to FIG. 4, FIG. 5 shows a second rotational position of a tremolo string tension regulator, which causes lock screw 502 and saddle assembly 503 to hold the string in a second tension. Tremolo string tension regulator 504 is in a rotational position such that fine turner screw 507 no longer rests against lock screw 502. Rather, tremolo base plate 505 is engaged with bearing surface 514 of tremolo string tensioner 504. Stop 516 abuts fine tuner screw 507 to prevent further rotation of tremolo string tension regulator 504.

In operation, a user may switch back and forth between the first tension and the second tension as frequently as desired by rotating tremolo string tension regulator 504. Leading edge 518 of bearing surface 514 may rest against tremolo base plate 505, but due to the force of fine tuner tension plate 509 as well as the string tension, undesired rotation to the second position will not occur. In the second position, friction, including that between bearing surface 514 and tremolo base plate 505, may prevent undesired rotation back to the first position. In another embodiment, bearing surface 514 could include a planar surface or otherwise be shaped so as to prevent rotation back to the first position. Bearing surface 514 may also comprise multiple geometries such as multiple diameters to provide several different possible string tensions.

In order for a tremolo to both raise and lower pitch, it must be "floating." This is accomplished, for example, by balancing the string tension with springs. Changing the tension of one or more strings such as that caused by use of a tremolo string tension regulator as disclosed herein may upset the balance between the strings and tremolo springs, thus resulting in the remaining strings going out of tune. One way to solve this problem is to block movement of the tremolo in one direction so that the tremolo can only move in one direction. Another way to solve this problem is by installing a device which applies a countering force against the tremolo such that the tremolo is still able to float while holding the other strings in tune. Such a device may be included in a tremolo string tension regulator system to solve the aforementioned issue.

Figure 6A:
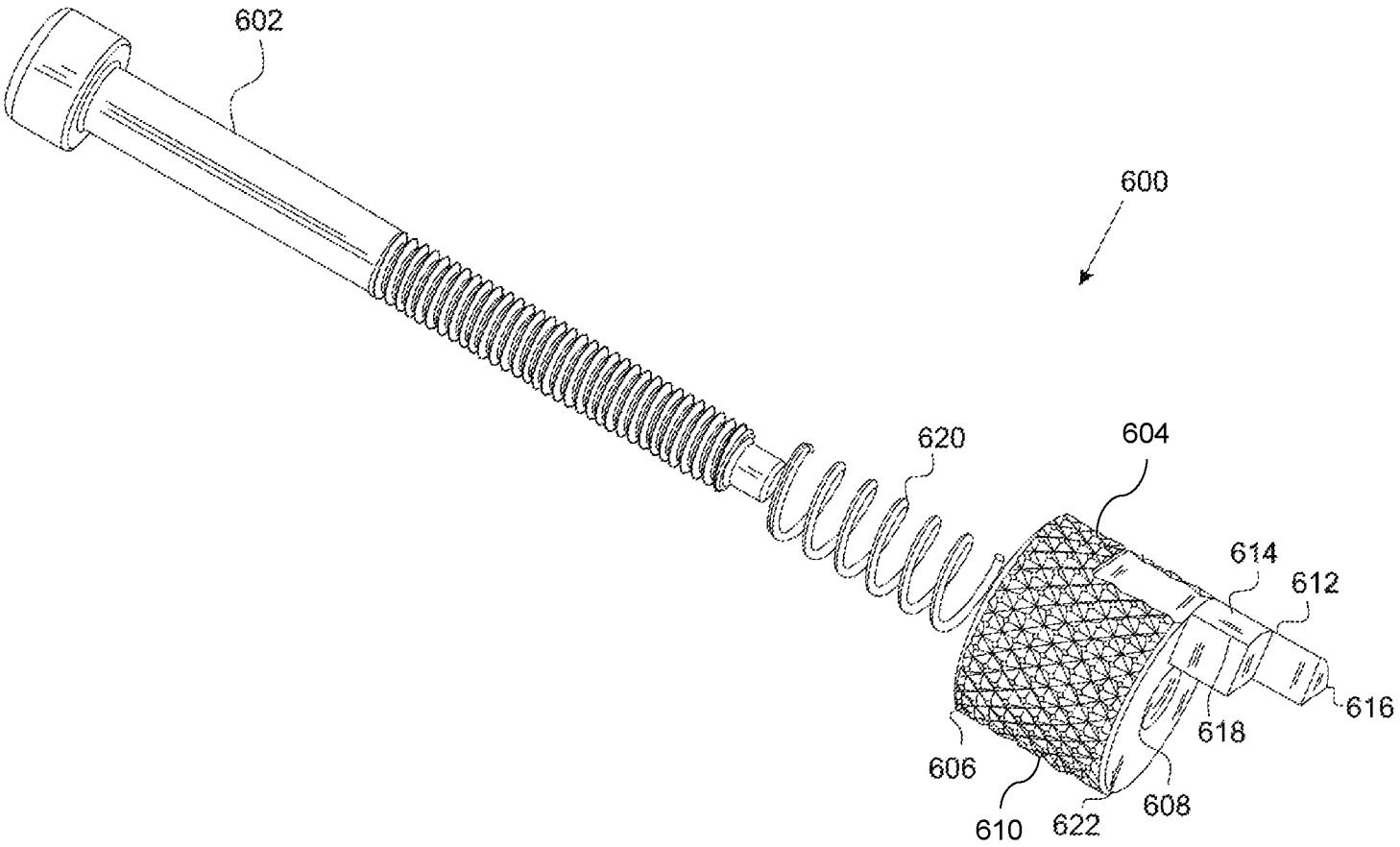
FIGS. 6A and 6B depicts a tremolo string tension regulator assembly according to one embodiment.
Figure 6B:
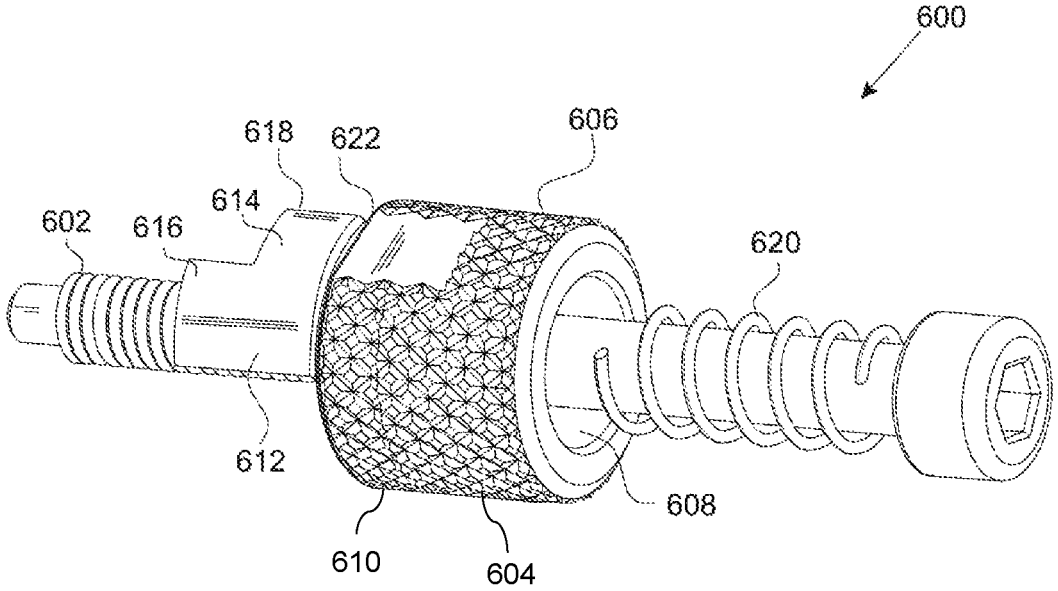

FIGS. 6A and 6B depicts a tremolo string tension regulator assembly 600 according to one embodiment. Tremolo string tension regulator assembly 600 is comprised of a lock screw 602 and a tremolo string tension regulator 604. Tremolo string tension regulator 604 is comprised of a rotatable body 606 having an axial hole 608 through the body. Lock screw 602 is only partially threaded along its length and therefore axial hole 608 is sized such that both the threaded and unthreaded portions of lock screw 602 pass through axial hole 608. Rotatable body 606 may therefore slide freely on lock screw 602.

Rotatable body 606 may include a textured surface 610 to facilitate grip on rotatable body 606. Textured surface 610 may include knurled, ribbed, or media blasted surfaces. Extending from rotatable body 606 is projection 612. Projection 612 extends axially from rotatable body 606 and includes a bearing surface 614 and a stop 616. Bearing surface 614 extends only partially around the circumference. Leading edge 618 defines one extent of the bearing surface. Stop 616 extends further axially from rotatable body 606 and bearing surface 614. Stop 616 only partially extends around the circumference and is rotationally offset from leading edge 618. Spring 620 is sized to fit over lock screw 602 and, in use, is constrained by the head of lock screw 602. Rabbet 622 defines a portion of rotatable body 606 extending radially beyond bearing surface 614. When installed, rabbet 622 is held against the tremolo base plate due to the force of spring 620. Thus, threading of axial hole 608 is not required to keep rotatable body 606 positioned properly. Further, spring 620 allows some variation in the axial position of lock screw 602 without affecting the operation of rotatable body 606.

Figure 7:
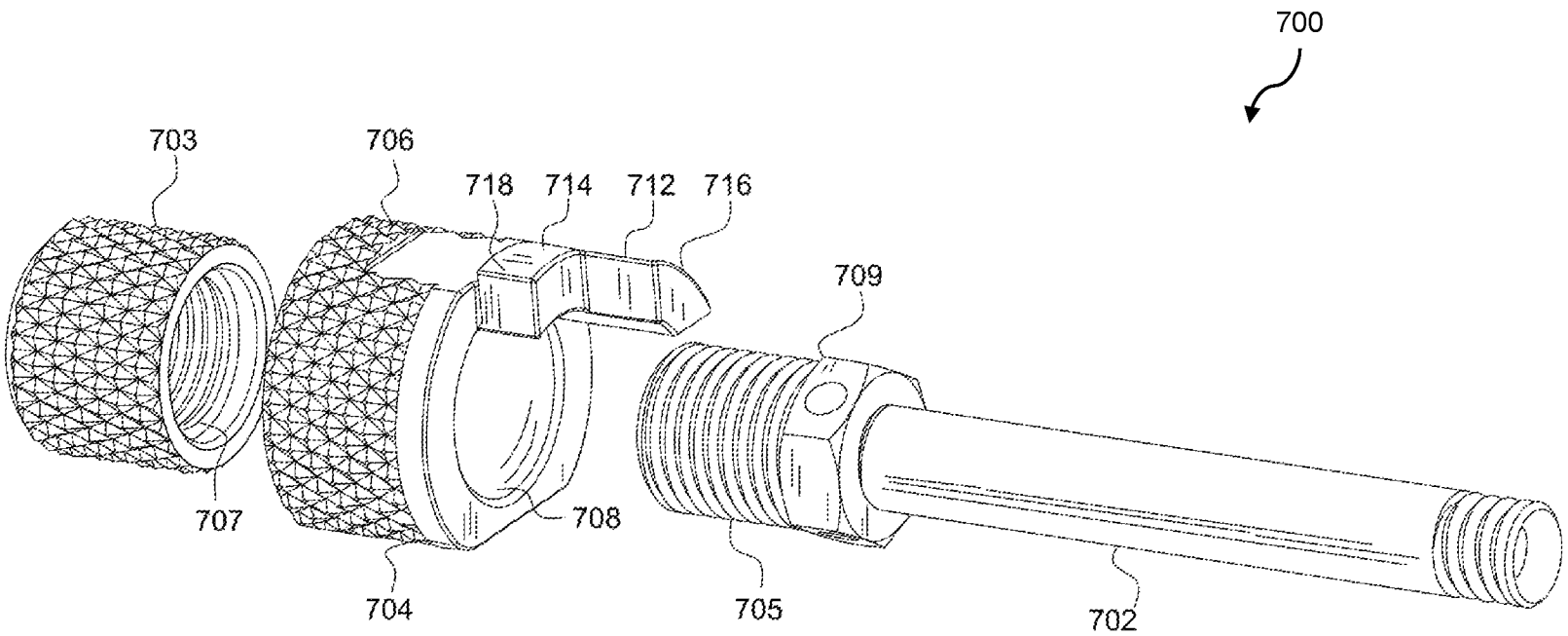
FIG. 7 depicts a tremolo string tension regulator assembly according to one embodiment.

FIG. 7 illustrates one embodiment of a tremolo string tension regulator system 700. Tremolo string tension regulator system 700 is comprised of a keyless lock screw 702, keyless lock screw head 703, and a tremolo string tension regulator 704. Keyless lock screw 702 and keyless lock screw head 703 are similar to the system described in U.S. Pat. No. 9,542,915 to Hackett. Keyless lock screw 702 has external threads 705 which may engage internal threads 707 of keyless lock screw head 703. Rabbet 709 defines a portion of keyless lock screw 702 having a diameter larger than the outer diameter of external threads 705 and is shown here having a hexagonal cross-section.

Tremolo string tension regulator 704 is comprised of a rotatable body 706 having an axial hole 708 through the body capable of receiving keyless lock screw 702. Axial hole 708 is sized to fit over external threads 705. A portion of axial hole 708 may be sized to fit over rabbet 709. Extending from rotatable body 706 is projection 712. Projection 712 extends axially from rotatable body 706 and includes a bearing surface 714 and a stop 716. Bearing surface 714 extends only partially around the circumference. Leading edge 718 defines one extent of the bearing surface. Stop 716 extends further axially from rotatable body 706 and bearing surface 714. Stop 716 only partially extends around the circumference and is rotationally offset from leading edge 718. In operation, rotatable body 706 is placed over external threads 705 and keyless lock screw head 703 is secured onto external threads 705. Tremolo string tension regulator 704 is held axially by a portion of axial hole 708 having a smaller diameter than rabbet 709 and keyless lock screw head 703.

Although the descriptions and figures depict the apparatus being utilized on a single string in practice it may be used simultaneously on more than one string and may be used on instruments with more or fewer than six strings. In addition, the functionality is equivalent for both right- and left-handed instruments.

It is also known by those skilled in the art that there are primarily two ways to obtain the desired pitch or frequency that a string will vibrate at. One is referred to as harmonic tuning where the length of the string or intonation determines the pitch. A stringed instrument typically has two critical points that determine a given string's length. One at the tremolo or bridge and the other at the nut. In general, shortening the length results in a higher pitch assuming the tension remains the same. The desired pitch may also be altered by increasing or decreasing the amount of tension on a string. A stringed instrument with the strings attached to tuning machines is typically "tuned" with this type of arrangement.

While the embodiments of this invention shown and described are fully capable of achieving the objects and advantages desired, it is to be understood that these particular embodiments shown have been for purposes of illustration only, and not for purposes of limitation. Not all of the activities or elements described above are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

What is claimed is:

1. A tremolo string tension regulator, comprising:

a rotatable body, the rotatable body having:

a bearing surface configured to selectively engage a base plate of a tremolo based on a rotational position of the rotatable body, and an axial hole through the rotatable body, wherein the axial hole comprises a threaded portion configured to engage threads of a lock screw of the tremolo, wherein the rotatable body is rotatable from a first position to a second position, wherein in the first position the bearing surface engages the base plate of the tremolo, causing the string to be at a first tension; and wherein in the second position the bearing surface does not engage the base plate of the tremolo, causing the string to be at a second tension.

2. The tremolo string tension regulator of claim 1, further comprising:

a stop extending axially from the rotatable body.

3. The tremolo string tension regulator of claim 1, wherein the stop is offset from a leading edge of the bearing surface.

4. The tremolo string tension regulator of claim 1, wherein the rotatable body has a textured surface.

5. The tremolo string tension regulator of claim 1, wherein the tremolo string tension regulator is sized to fit on a recessed tremolo of a guitar without modification of a body of the guitar.

6. The tremolo string tension regulator of claim 1, wherein the body is cylindrically shaped.

7. A tremolo string tension regulator system, comprising:

a lock screw having a shank and a head;

a spring positioned around the shank of the lock screw; and a rotatable body positioned around the shank of the lock screw, the rotatable body having:

a bearing surface, and an axial hole through the rotatable body, wherein the spring is positioned between the head of the lock screw and the rotatable body, wherein the rotatable body is rotatable from a first position to a second position, wherein in the first position the bearing surface engages the tremolo, causing the string to be at a first tension; and wherein in the second position the bearing surface does not engage the tremolo, causing the string to be at a second tension.

8. The tremolo string tension regulator system of claim 7, wherein the spring is positioned between a head of the lock screw and the rotatable body.

9. The tremolo string tension regulator of claim 7, wherein the tremolo string tension regulator is sized to fit on a recessed tremolo of a guitar without modification of a body of the guitar.

10. The tremolo string tension regulator of claim 7, further comprising:

a stop extending axially from the rotatable body.

11. The tremolo string tension regulator of claim 7, wherein the stop is offset from a leading edge of the bearing surface.

12. The tremolo string tension regulator of claim 7, wherein the rotatable body has a textured surface.

13. A tremolo string tension regulator system, comprising:

a keyless lock screw having external threads, a keyless lock screw head having internal threads configured to thread onto the external threads of the keyless lock screw; and a rotatable body positioned between the keyless lock screw and the keyless lock screw head, the rotatable body having:

a bearing surface, and an axial hole through the rotatable body, wherein the axial hole comprises a threaded portion configured to thread onto the external threads of the keyless lock screw, wherein the rotatable body is rotatable from a first position to a second position, wherein in the first position the bearing surface engages the tremolo, causing the string to be at a first tension; and wherein in the second position the bearing surface does not engage the tremolo, causing the string to be at a second tension.

14. The tremolo string tension regulator of claim 13, wherein the tremolo string tension regulator is sized to fit on a recessed tremolo of a guitar without modification of a body of the guitar.

15. The tremolo string tension regulator of claim 13, further comprising:

a stop extending axially from the rotatable body.

16. The tremolo string tension regulator of claim 13, wherein the stop is offset from a leading edge of the bearing surface.

17. The tremolo string tension regulator of claim 13, wherein the rotatable body has a textured surface.

* * * * *